US005510667A

United States Patent [19]

Löffler et al.

[11] Patent Number: 5,510,667

[45] Date of Patent: Apr. 23, 1996

[54] SPARK PLUG WITH AN ELECTRODE HAVING A PLATINUM-NICKEL FIBER COMPOSITE MATERIAL

[75] Inventors: Otto Löffler, Stuttgart; Werner Niessner, Steinheim; Heinz Ambacher, Benningen; Friedrich E. Schneider, Pforzheim, all of Germany

[73] Assignees: Beru Ruprecht GmbH & Co.; G. Rau GmbH & Co., Germany

[21] Appl. No.: 15,024

[22] Filed: Feb. 5, 1993

[30] Foreign Application Priority Data

Feb. 5, 1992 [DE] Germany ..... 42 03 251.2

[51] Int. Cl.[6] ..... H01T 13/02

[52] U.S. Cl. ..... 313/141

[58] Field of Search ..... 313/141, 141.1, 313/131 A, 135

[56] References Cited

U.S. PATENT DOCUMENTS

| | | | |
|---|---|---|---|
| 4,093,887 | 6/1978 | Corbach et al. | 313/141 |
| 4,465,952 | 8/1984 | Sato et al. | 313/141 |
| 4,540,910 | 9/1985 | Kondo et al. | 313/141 |
| 4,581,558 | 4/1986 | Takamura et al. . | |
| 4,670,684 | 6/1987 | Kagawa et al. . | |
| 4,743,793 | 5/1988 | Toya et al. | 313/141 |
| 4,771,210 | 9/1988 | Möhle et al. | 313/141 |
| 5,210,457 | 5/1993 | Oshima et al. | 313/141 |

FOREIGN PATENT DOCUMENTS

| | | |
|---|---|---|
| 0171994 | 2/1986 | European Pat. Off. . |
| 2508490 | 9/1976 | Germany . |
| 3433683 | 6/1985 | Germany . |
| 60-125339 | 7/1985 | Japan . |
| 1528514 | 10/1978 | United Kingdom . |

*Primary Examiner*—Sandra L. O'Shea
*Assistant Examiner*—Vip Patel
*Attorney, Agent, or Firm*—Sixbey, Friedman, Leedom & Ferguson; David S. Safran

[57] ABSTRACT

Spark plug with an insulator, a center electrode placed in the insulator, a casing provided on the outside off the insulator and a casing electrode attached to the casing. The center electrode and/or the casing electrode are made using a platinum-nickel fiber composite material consisting of a platinum matrix in which nickel fibers are embedded or of a nickel matrix in which platinum fibers are embedded.

10 Claims, 5 Drawing Sheets

Fig. 1
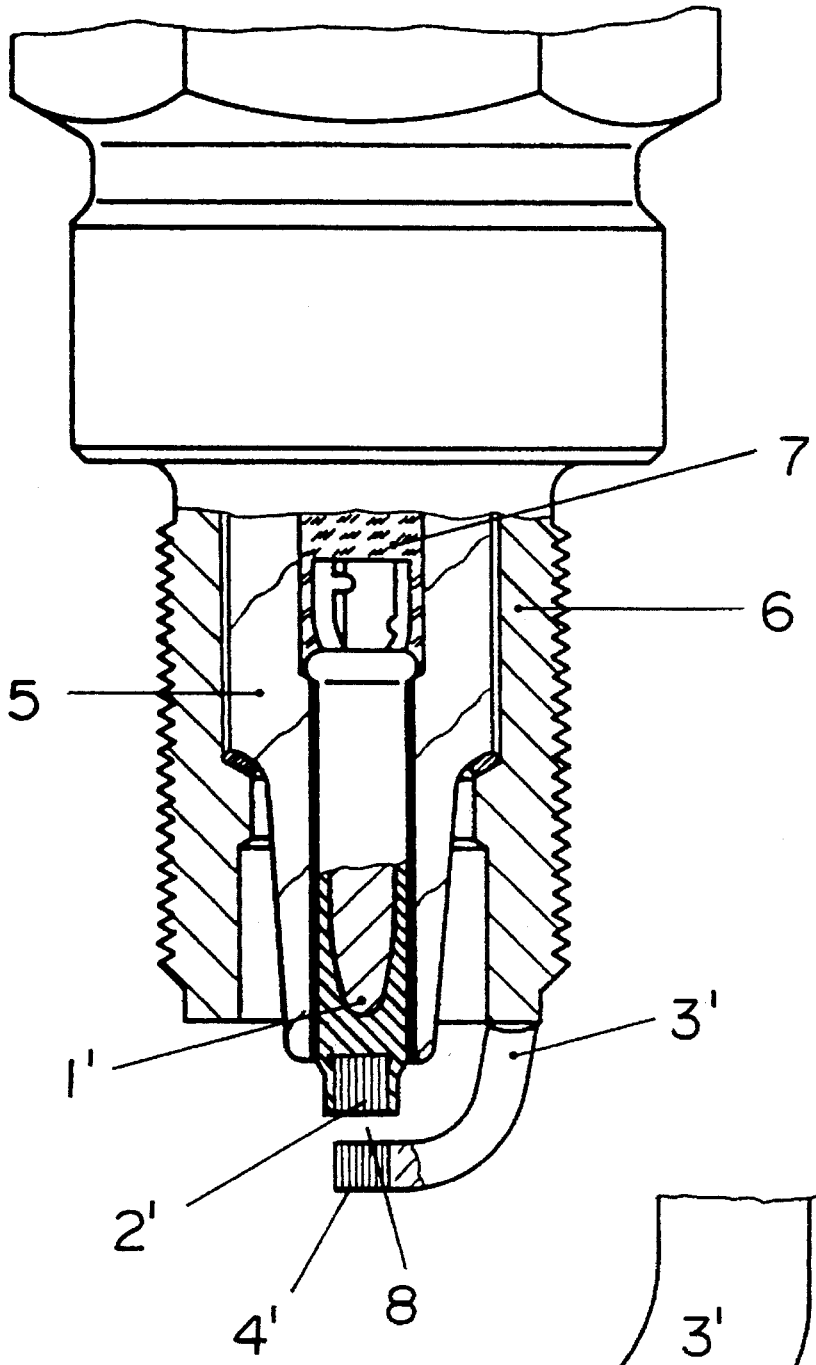
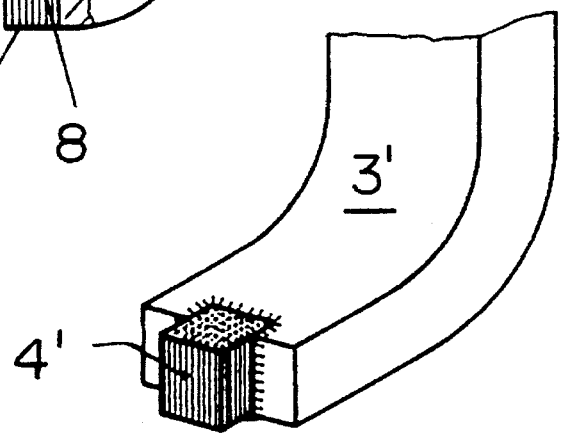
Fig. 1a

SPARK PLUG WITH AN ELECTRODE HAVING A PLATINUM-NICKEL FIBER COMPOSITE MATERIAL

BACKGROUND OF THE INVENTION

1. Field of the Invention

The invention relates to a spark plug with an insulator, a center electrode placed in the insulator, a casing placed on the outside of the insulator and a casing electrode attached to the casing.

2. Description of Related Art

In spark plugs of the type to which the invention is directed, the center electrode and/or the casing electrode are, usually, made of silver or nickel alloys or of a nickel-copper binary material. Additionally, spark plugs with platinum electrodes as the center electrode and/or casing electrode also are known.

From German Offenlegungsschrift 2 508 490, there is also known a silver-nickel composite material in the form of a silver-nickel fiber composite for electrodes and a process for its production.

In a spark plug with platinum electrodes, large amounts of platinum are needed as erosion reserves for a long lifetime of the spark plug, for example, for gasoline engines, a life of over 1,000 hours. The platinum must further be protected from carbonization, and the high compression pressures in gasoline engines necessitate small electrode gaps. But, small electrode gaps of, for example, 0.3 mm are difficult to establish. The use of platinum metals and platinum alloys for the production of electrodes is further connected with high costs.

SUMMARY OF THE INVENTION

In FIG. 4, a known spark plug is represented. This spark plug has an insulator 5, a center electrode 1, which is placed in the insulator and is made of a nickel sheath 1*a* and a copper core 1*b* with a platinum-nickel insert 2, a casing 6 that is located on the outside of the insulator 5 and a casing electrode 3 that is attached to the casing 6 and is made of nickel or Inconel or a nickel sheath, copper core with a platinum-nickel disk. The center electrode 1 is held in insulator 5 by a glass seal 7, optionally, with a suppression or erosion resistor. Spark air gap 8 is located between casing electrode and center electrode 3, 5.

The primary object of the present invention, therefore, lies in making a spark plug of the above-mentioned type that achieves a long lifetime at lower costs.

This object is achieved according to the invention by a design in which the center electrode and/or the casing electrode is made using a platinum-nickel fiber composite material consisting of a platinum metal matrix in which nickel fibers are embedded or of a nickel matrix in which platinum fibers are embedded.

In the spark plug according to the invention, at least the center electrode or the casing electrode is made of a platinum-nickel fiber composite material, which reduces the amount of platinum or platinum alloy needed, and thus, leads to a considerable cost savings.

The use of wider electrode gaps, made possible by a low ignition voltage requirement, make it possible to thin the combustion mixture. This leads, overall, to a higher machine efficiency and to lower fuel consumption. If the manufacturing difficulties of small electrode gaps are accepted, then, the greater erosion reserve yielded by the latter leads to a longer lifetime.

If, in particular, the electrodes of the spark plug are made such that pieces or disks made of the platinum-nickel fiber composite material are embedded in the ignition-spark end of the electrodes or are attached there, and the electrodes can consist of a usual electrode material such as, for example, a nickel-copper binary, the platinum is protected from carbonization. By the point effect and field distortion between the nickel, as magnetic material, and the platinum, as nonmagnetic material, a lower response voltage results. I.e., during ignition, the nickel is first eroded and the platinum protrudes. Since platinum eliminates heat even better than nickel, the nickel is additionally cooled, which leads overall to a better useful life.

When fiber composite material pieces or disks made of the platinum-nickel fiber composite are placed on the ignition-spark end of electrodes made of a base material such as, for example, nickel-copper binary, a further savings of platinum material, connected with high costs, results.

Because of thermal expansion, it is preferred to provide 100 to 6,000 nickel or nickel alloy fibers per $mm^2$ of the composite material in the platinum matrix. The nickel alloy can be a usual spark plug nickel alloy, preferably with 1–4% silicon and 0.3% magnesium.

Tubes made of nickel or a nickel alloy can also be provided that are filled with substances such as, for example, metal oxides or semiconducting substances, that lower the work function for the electrodes, and can be placed in a platinum matrix and formed until only thin nickel fibers are present.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 is a partial sectional view of an embodiment of a spark plug according to the invention;

FIG. 1*a* is a perspective view of the ignition spark end of the top electrode of the spark plug represented in FIG. 1;

DETAILED DESCRIPTION OF THE PREFERRED EMBODIMENTS

Figure 5:
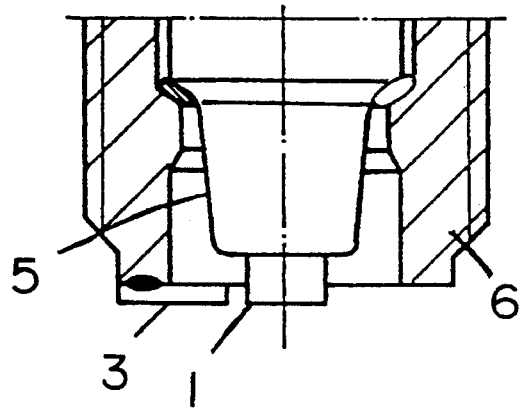
FIGS. 5, 5*a*, & 5*b* are, respectively, a partial sectional view and two top views of conventional casing electrode arrangements.
Figure 5A:
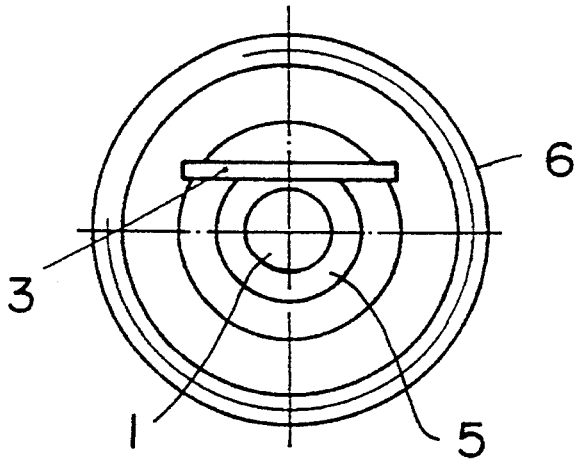
Figure 5B:
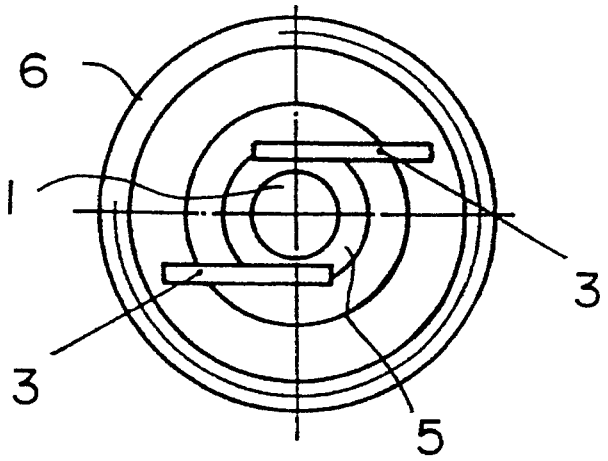

In FIGS. 5, 5*a*, 5*b*, there are represented casing electrode arrangements that are currently commonly made of solid platinum or gold-palladium materials. According to the invention, advantageously, these can also be made of a platinum-nickel fiber composite material. In this regard, the composite materials used in accordance with the present invention can be produced in accordance with any of the many known processes for producing fiber composite materials of which the process for producing silver-nickel electrodes disclosed in the above-mentioned German Application No. 2 508 490 is an example. Thus, such processes and the manners by which the fibers are oriented in the matrix of the composite, itself, forms no part of the present invention.

Figure 4:
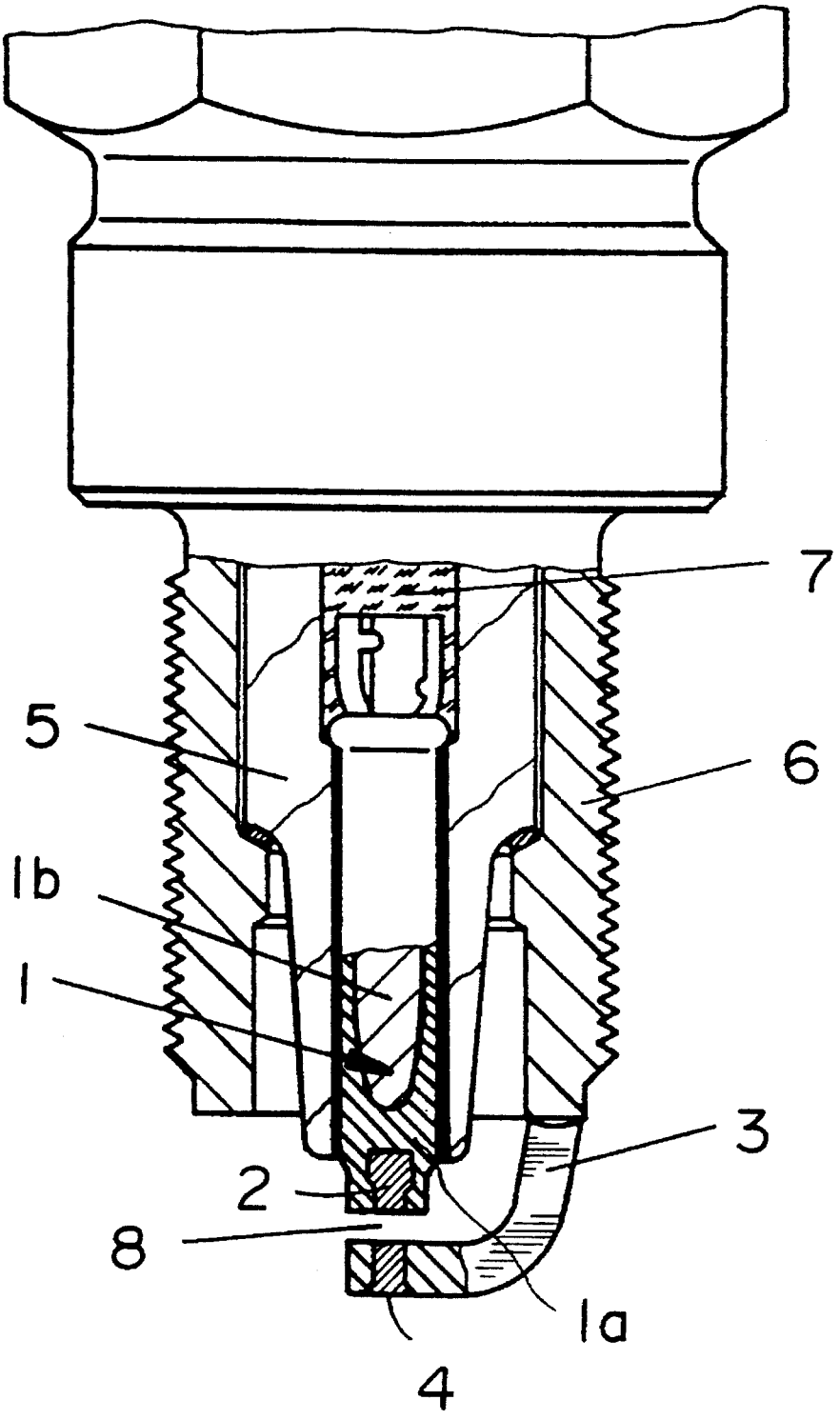
Fig. 4 (PRIOR ART)
FIG. 4 is a partial sectional view of a known platinum spark plug.

The first embodiment of the spark plug according to the invention is represented in FIGS. 1 and 1*a* and corresponds in its basic design to the known spark plug design represented in FIG. 4, except for the design of center electrode 1 and casing electrode 3. Thus, like reference numbers have been utilized for corresponding parts which are unchanged, and prime (') designations have been applied to corresponding parts which have been modified in some way.

Center electrode 1' has an insert 2' made of a platinum-nickel fiber composite material consisting of a platinum matrix in which nickel fibers or nickel alloy fibers are embedded. This insert 2' can be embedded in an electrode made of a conventional electrode base material such as, for example, a nickel-copper binary. Likewise, on the ignition spark side of casing electrode 3', a similar insert 4' made of the platinum-nickel fiber composite material can be provided. Inserts 2' and 4' can be attached as disks or plates to the electrode ends, for example, they can be welded on or embedded in them, for example, by being mortised. The disks or plates can protrude from the nickel casing or center electrode 1', 3' in the direction of the spark path. If the fiber composite material is embedded in the electrode base material, the advantage results that the platinum is embedded on the outside of the ignition point and is protected from carbonization in a rich mixture.

Figure 2:
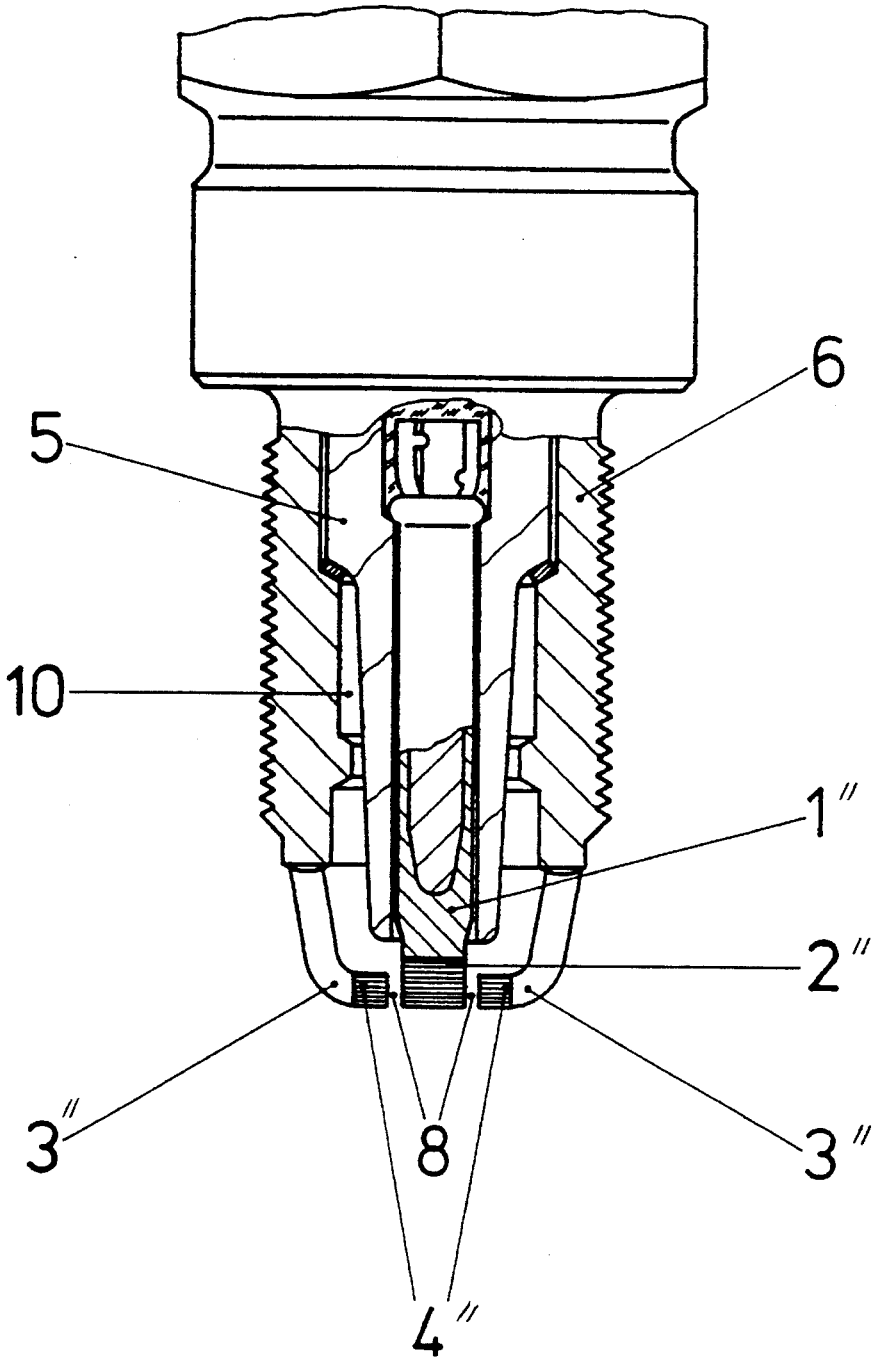
FIG. 2 is a partial sectional view of another embodiment of the spark plug according to the invention.

As it is represented in FIG. 2, one or more top electrodes 3" with suitable inserts or attachments 4" made of the platinum-nickel fiber composite material can be provided as casing electrodes. In the spark plug represented in FIG. 2, with two side electrodes 3", fiber composite insert 4" has its fibers running in the ignition direction. But the fibers can also run crosswise to the ignition direction, if they are exposed on the surface, as in FIG. 1.

Figure 3:
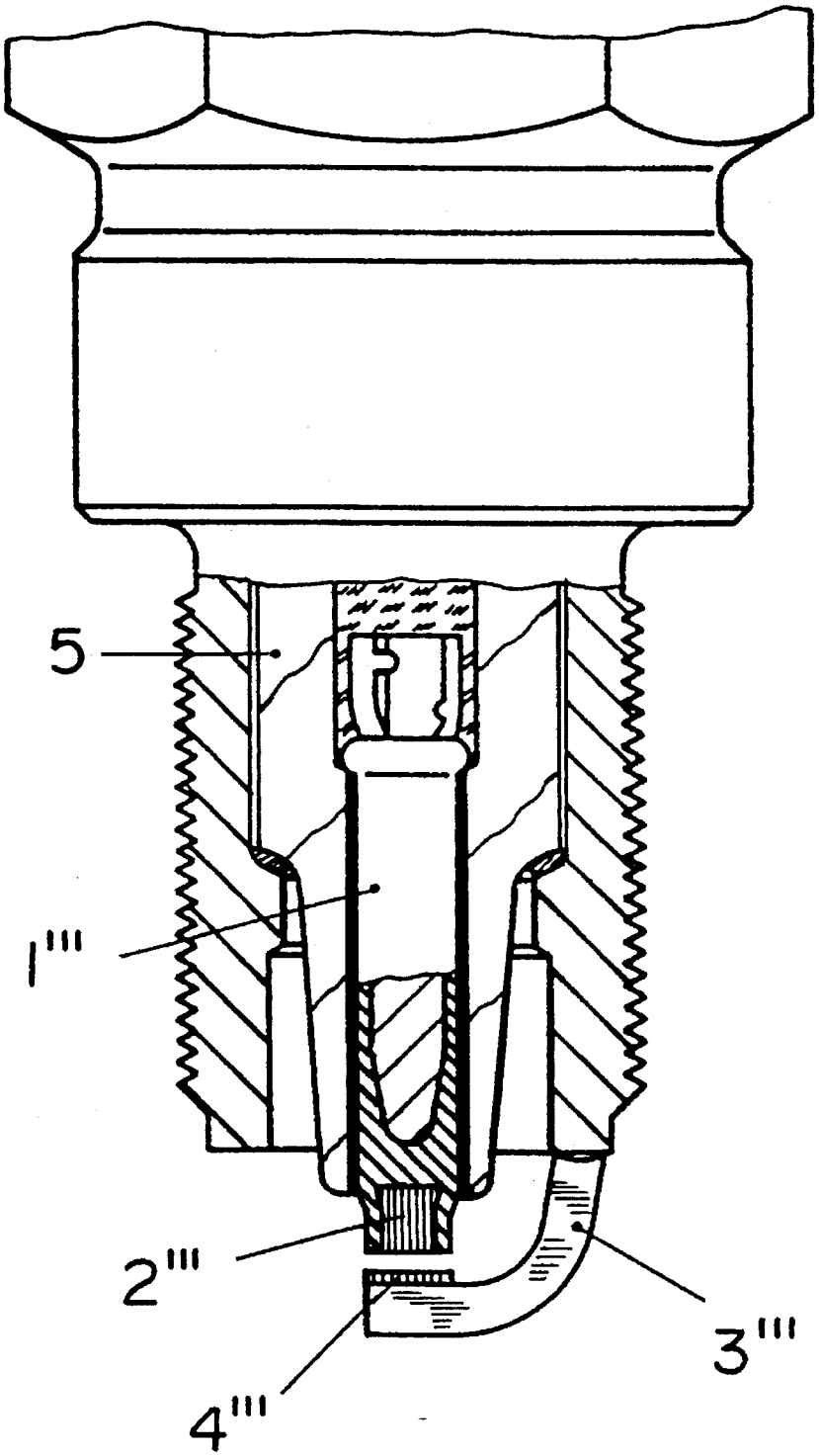
FIG. 3 is a partial sectional view of yet another embodiment of the spark plug according to the invention.

In FIG. 3, another embodiment of the spark plug according to the invention is represented in which center electrode 1''' is provided with a fiber composite material insert 2''' and a disk 4''' made of the fiber composite material is provided on casing electrode 3'''.

It is also possible to use an electrode, i.e., the center electrode or the casing electrode, which is made of a platinum-nickel fiber composite material in combination with a usual counter-electrode made of a nickel electrode material. That is, an electrode of a usual nickel alloy with preferably 1–4% Si and 0.3% Mg., with a nickel-copper binary electrode as center or casing electrode, with a silver-copper binary electrode or with a silver-nickel fiber composite electrode. Further, suppression or erosion resistors 7 (FIG. 1) with a wire-wound base or glass seal can also be provided. An ignition area with a combination of spark gap in air and surface discharge spark gap leads to a reduction in the response voltage. If firing chamber 10 (FIG. 2) is provided, improved insulator cleaning results.

Gasoline engines should make do with as lean a mixture as possible to achieve good efficiency, which is decisive for sales success. These mixtures are not homogeneous in the boundary area. Thus, it is necessary to work with spark plugs that have a wide electrode gap, to be able to ignite as lean an ignitable mixture as possible.

Caused by the high compression pressures, there is a high response voltage by which, in turn, the size of the electrode gap, with respect to the ignition voltage available, is limited.

In the spark plug according to the invention, it is possible, despite high compression, to still achieve a wide electrode gap and an acceptable response voltage. Here, other physical effects, such as a point effect and field distortion, come into play because of the combination of the nonmagnetic and magnetic materials platinum and nickel.

The fiber composite material made of nickel and platinum fulfills the requirement for a lower electrode erosion rate, since it is an erosion-resistant and chemically stable material, which makes possible a long lifetime for the corresponding spark plug. The platinum and the nickel alloy are sufficiently erosion-resistant. Only after several 100 hours of running time does platinum, compared to nickel, appear somewhat pitted on the erosion surface and specifically over the entire fiber composite surfaces in the combustion area of the sparks. Together with the field distortion at the separation points between the magnetic nickel and the nonmagnetic platinum, this leads to intensified point effects, which applies to both the casing electrodes and to the center electrodes of the spark plugs.

By using additives that lower the work function, such as, for example, metal oxides and semiconductors that withstand the combustion chamber conditions, the response voltage can be further lowered. In addition, instead of wires, thin nickel tubes filled with such substances are used as inserts in the platinum matrix and are formed until the nickel is present as thin fibers.

The platinum-nickel fiber composite material can be mortised in the form of a disk, e.g., in a center electrode made of solid material, can be welded over the entire diameter, can be provided with fiber direction in the axis and crosswise to the axis, can be welded to the casing electrode, i.e., be welded on the face, or be placed as a rivet in a casing electrode bore.

It is further possible to put platinum rods in a nickel matrix and form them until sufficiently fine fibers of platinum are present. During erosion, after a prolonged operating time, platinum points then appear above the more greatly eroding nickel matrix.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A spark plug with an insulator, a center electrode placed in the insulator, a casing located on the outside of the insulator and a casing electrode attached to the casing, wherein at least one of the center electrode and the casing electrode comprises a platinum-nickel fiber composite material from the group consisting of a platinum metal matrix in which nickel fibers are embedded and a nickel matrix in which platinum fibers are embedded.

2. A spark plug according to claim 1, wherein the platinum-nickel fiber composite material is attached on the ignition spark end of at least one of the center electrode and the casing electrode in a spark area.

3. A spark plug according to claim 2, wherein the the platinum-nickel fiber composite material is embedded in the ignition spark end of at least one of the center electrode and the casing electrode in the spark area.

4. A spark plug according to claim 2, wherein a disk or plate made of the platinum-nickel fiber composite material is welded onto the ignition spark end of the at least one of the casing electrode and the center electrode.

5. A spark plug according to claim 4, wherein the fibers of the fiber composite material are oriented in an ignition spark direction.

6. A spark plug according to claim 3, wherein the fibers of the fiber composite material are oriented in an ignition spark direction.

7. A spark plug according to claim 2, wherein the fibers of the fiber composite material are oriented in an ignition spark direction.

8. A spark plug according to claim 1, wherein the fibers of the fiber composite material are oriented in an ignition spark direction.

9. Spark plug according to claim 1, wherein 100 to 6,000 nickel fibers are provided per square millimeter of platinum matrix.

10. Spark plug according to claim 1 wherein the fibers are embedded within the matrix at an exposed end of the electrode.

* * * * *